United States Patent [19]

Mattila

[11] Patent Number: 4,610,035

[45] Date of Patent: Sep. 9, 1986

[54] UPPER BODY PROTECTOR

[76] Inventor: Heikki Mattila, SF-89200 Poulanka, Finland

[21] Appl. No.: 745,123

[22] Filed: Jun. 17, 1985

[51] Int. Cl.[4] ..... A41D 13/00

[52] U.S. Cl. ..... 2/2; 24/453; 24/573

[58] Field of Search ..... 2/2, 2.5, 338; 24/265 R, 453, 519, 573, 575, 615

[56] References Cited

U.S. PATENT DOCUMENTS

| | | | |
|---|---|---|---|
| 1,136,307 | 4/1915 | Bourdan | 2/2 |
| 1,489,048 | 4/1924 | Whitley | 2/2 |
| 2,001,508 | 5/1935 | Tobin | 2/2 |
| 2,045,157 | 6/1936 | Mathias | 24/453 X |
| 2,638,598 | 5/1953 | Abramson | 2/338 X |
| 2,743,684 | 5/1956 | Elsner | 24/265 X |
| 3,076,197 | 2/1963 | Glahe | 2/2 |
| 3,452,362 | 7/1969 | Korolick et al. | 2/2.5 |
| 3,803,639 | 4/1974 | Cohen | 2/2.5 |
| 3,883,928 | 5/1975 | Blake | 24/573 |
| 4,497,069 | 2/1985 | Braunhut | 2/2.5 |

*Primary Examiner*—Louis K. Rimrodt
*Attorney, Agent, or Firm*—Andrus, Sceales, Starke & Sawall

[57] ABSTRACT

The upper body protector comprises a semirigid chest plate portion, a suspender portion and left and right shoulder portions said portions adapted to conformably embrace the corresponding parts of a wearer. According to the invention an adjusting device connects said suspender portion and said chest plate portion together so that they are adjustable in a mainly vertical manner with respect to each other.

7 Claims, 8 Drawing Figures

UPPER BODY PROTECTOR

The object of the invention is an upper body protector for sportsmen. Advantageously the protector is worn during indulging in various motorsports especially in motorcycling such as motorcross and the like.

BACKGROUND OF THE INVENTION

Upper body protectors, which include a chest plate, a suspender portion or portions, shoulder portions, as well as probable arm and back protectors, are worn nowedays, when indulging in motor sports. Said portions have been connected to each other either by riveting or riveted connections so that the portions bend and flex with respect to each other according to the movements of the wearer. Said portions are mainly of hard, flexible material for example plastic, and the portions have been fully or partly padded from inside. In additon the protectors usually include bands which have been manufactured of partly or fully extensible material with which the protector can be secured upon the wearer. Upper body protectors have been described for example in the U.S. Pat. No. 4,467,475.

A drawback of the known upper body protectors is that they are unadaptable to be worn by persons of various sizes. Thus, the protectors have to be manufactured in various sizes or, if only one size is manufactured it won't fit anyone well as the size and form will be a compromise of the needs of the wearers.

SUMMARY OF THE INVENTION

The object of the invention is to obviate the drawbacks mentioned above. Especially the object of the invention is to bring about an upper body protector with various portions that can be advantageously adjusted with respect to each other according to the wearer's physique.

The characteristic features of the invention become clear from the claims.

The upper body protector according to the invention includes a chest plate portion, suspender and shoulder portions which have been advantageously shaped to correspond to the human anatomy. Said portions of the protector are mainly of flexible and hard sheet material such as plastic.

The suspender portion is preferably formed of two separate shoulder portions, namely the left and right shoulder portions which can be fixed in a vertically adjustable manner to the chest portion.

In one advantageous embodiment of the invention the left and right shoulder portions have been fixed to the corresponding suspender portions so that the shoulder portions can be adjusted and fixed in relation to the suspender portions according to the width of the wearer's shoulders. Arm portions have been advantageously fixed, for example by stiching, to the lower part of the shoulder portions. Said arm portions protect the wearer's arms and include advantageoulsy elastic bands in order to ensure that the respective protector portions are secured into their place upon the wearer.

A back protector has been included in another advantageous embodiment of the upper body protector. The back protector can be connected in a vertically adjustable manner to the suspender portion.

The means of adjustment located on the various plate-like portions of the protector are advantageously formed of a recess in one portion and a portrusion located on a corresponding other portion so that the portrusion can be moved allong the recess. The lower surface of the recess includes advantageously equally sized holes which correspond to the hole on the surface of the portrusion. Thus, a bolt can be placed through the aligned holes and tightened to its place by a nut. In this manner by choosing a suitable hole from the recess for fixture the size of the upper body protector can be varied.

In a further modification of the invention the recess includes one long rectangular hole in the recess, and the corresponding surfaces of the portrusion and recess include corresponding nodules or slots. Thus, the locking of the adjusting means takes place by securing the corresponding nodules or slots against each other by tightening the nut and bolt.

In a further modification the hole in the recess is formed of a slot that includes widennings that give the slot a wave-like edge. Thus the means of adjustment are clamped together by the nut and bolt through the suitable widenning.

In a further modification of the invention the adjusting means consists of equally spaced holes in the portions of the protector and locking means for the holes. Thus the holes on the adjustable portions can be situated on an large area both in a lateral and vertical direction. In this manner the adjusting could be made even easier.

Considerable savings are achieved in the manufacturing costs of an upper body protector according to the invention, because the same protector can be adjusted according to the wearer's physique. Thus, the need to manufacture protectors for the various sizes of the wearers is obviated.

An inprovement in the comfort of the protector is also achieved, because the various parts of the protector can be adjusted according to the wearer's desires.

DESCRIPTION OF THE DRAWINGS

The invention is explained in detail by refearing to the accompanying drawings, where.

DESCRIPTION OF THE ILLUSTRATED EMBODIMENT

Figure 1:
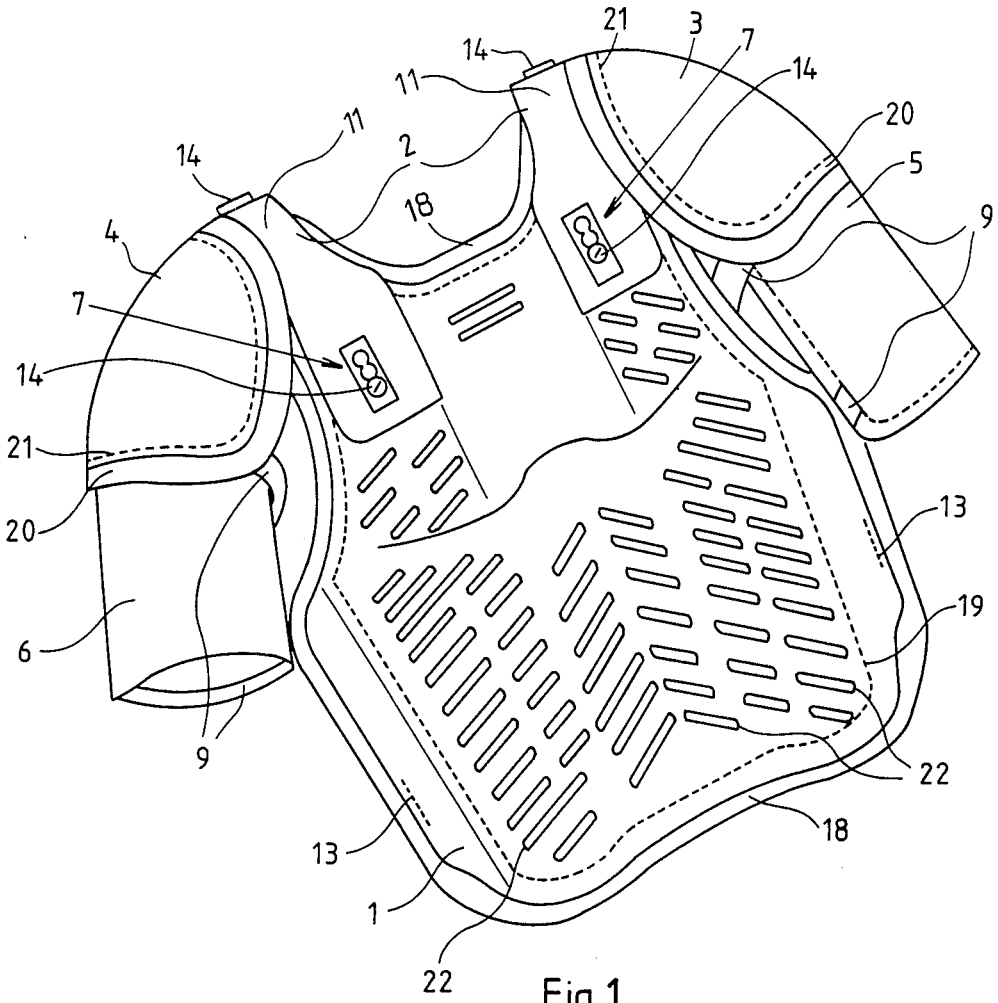
FIG. 1 shows an upper body protector in accordance with the present invention.

An upper body protector according to the invention is shown in FIG. 1 which protector includes a chest plate portion 1, left and right suspender portions 11, 12 which have been connected in a mainly vertically adjustable manner to the chest plate by means of adjustment, corresponding left and right shoulder portions 3, 4 which have been connected to the suspender portions as well as left and right upper arm portions 5, 6. The chest plate, shoulder and suspender portions are formed of hard flexible sheets of plastic according to the human anatomy. A padding 18 has been stitched by stitches 19 to the inner edge of the chest plate. Another padding 20 has been stitched by stitches 21 to the inner sides of the shoulder portions 3, 4 in order to cover the whole inner area of the shouder portions. The upper arm portions that have been connected to the suspender portions include extensible bands 9 in order to secure the upper arm portions upon the wearer's arms. In addition the chest plate portion includes airing slots 22 in order to make the wearing of the protector comfortable. The means of adjustment between the chest plate portion 7 and the suspender portions 11, 12 have been described in more detail in conjunction with FIGS. 6 and 7.

Figure 2:
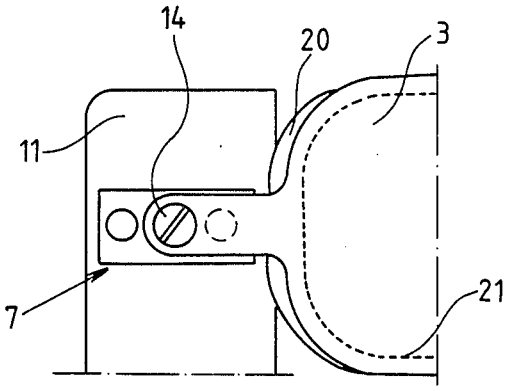
FIG. 2 shows a detail of another upper body protector in accordance with the present invention.

FIG. 2 shows a part of an upper body protector according to the invention. In the upper body protector the shoulder portion 3 has been connected to the suspender portion 11 by means of adjustment 7 so that the shoulder portion 3 can be adjusted laterally by the holes and bolts 14 of said means according to the wearer's width of shoulders.

Figure 3:
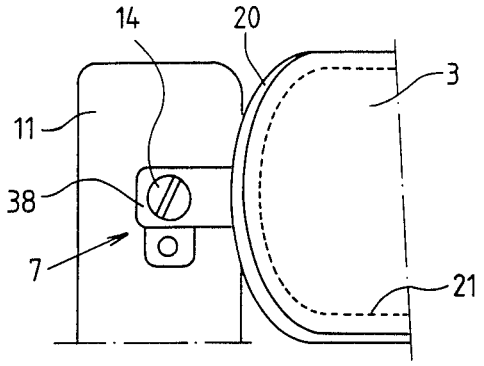
FIG. 3 shows an alterntive construction to that in FIG. 2 which alternative is in accordance with the present invention.

Another means of adjustment between the shoulder portion 3 and the suspender portion 11 has been presented in FIG. 3. Said means of adjustment 7 include holes and a locking bolt that can be placed within the holes as well as a connecting piece 38 which advantageously is an extensible band which has been connected from one end to the padding 20, and the other end of the piece 38 includes a hole fitted for the bolt 14 for connecting the piece 38 by the bolt to the desired hole of the suspender portion. In this case the adjusting takes place in a direction parallel to the length of the suspender portion, which is an opposite case to that presented in FIG. 2, where the adjustment takes place crosswise with respect to the length of the suspender portion. It is also possible to combine the adjusting facilities of FIGS. 2 and 3. This would achieve both lengthwise and crosswise adjustment with respect to the shoulder portion.

Figure 4:
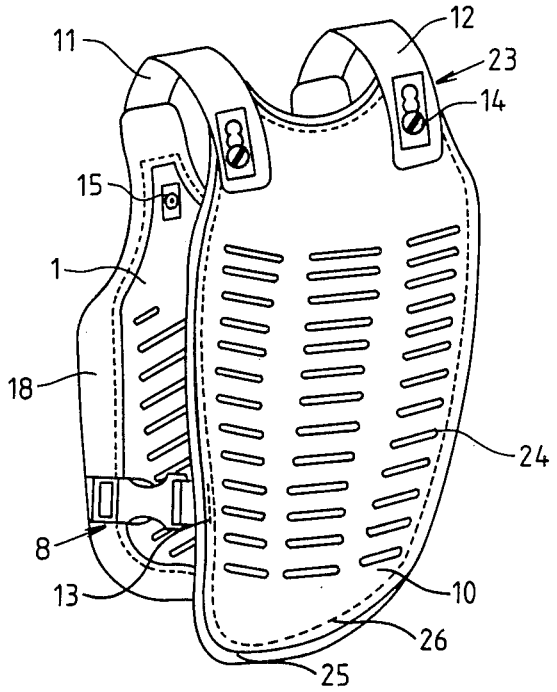
FIG. 4 shows another construction of an upper body protector in accordance with the invention.

A part of an upper body protector according to the invention has been shown in FIG. 4. The protector includes a chest plate portion 1 according to that presented in FIG. 1, suspender portions 11 and 12 as well as a back plate portion 10 which is connected in a mainly vertically adjustable manner by means of adjustment 23 to the suspender portions. The back plate portion includes airing slottings 24 and an edge padding 25 connected by stitches 26 to the inner edge of said back plate. The chest and back plate portions 1, 10 are connected to each other by webbing means 8 which are connected to the vertical edges of said portions. The webbing means consists advantageously of two extensible bands which other ends have been stitched to the chest and back plate portions, and the opposite ends of said bands include two corresponding parts of a clamping device for clamping the ends of said bands together. The means of adjustment 23 include an adjusting slot 27 which includes widennings that give the slot a wave-like edge. The means of adjustment can be, thus, clamped to the desired position by the bolt 14 through the suitable widenning. The shoulder and arm portions that are included in the protector have not been shown.

Figure 5:
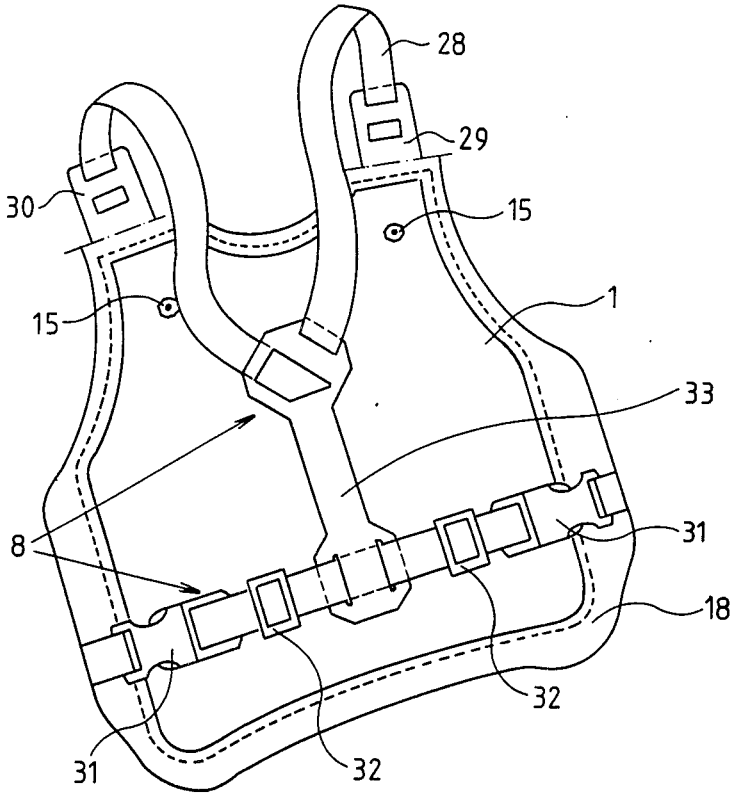
FIG. 5 shows a band construction in accordance with the invention.

FIG. 5 shows the structure of a webbing means 8 according to the invention which webbing means can be used in conjunction with an upper body protector which doesn't include a back plate portion. The webbing means 8 include a band 28 connected to the upper parts 29, 30 of the chest plate portion so that one end of the band has been connected to the upper part 29 and the other end to the upper part 30. An adjustable webbing structure has been connected to the lower parts of the vertical edges of the chest plate portion which webbing structure includes extensible bands, clasps 31, buckles 32 and a connector which connects the middle part of the webbing structure to the middle part of the band 28. The padding 18 has been cut of from the upper parts of the chest plate portion allong the dotted dash lines in order to demonstrate how the band 28 has been connected to the upper parts 29, 30 of the chest plate.

Figure 6:
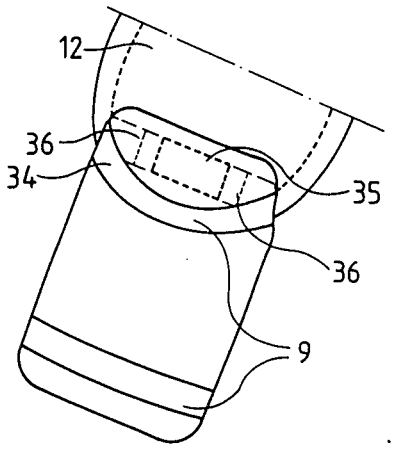
FIG. 6 shows an upper arm construction in accordance with the invention.

FIG. 6 shows a connection, in accordance with the invention, between the arm portions 5, 6 and the corresponding suspender portions. The upper band 34 of the arm portion is circular and placed arround the arm portion. Stitches 35 connect the band to the arm portion and stitches 36 connect the band to the suspender portion. Thus, the connection becomes flexible and won't restrict the movement of the arms, while the protector is worn.

Figure 7:
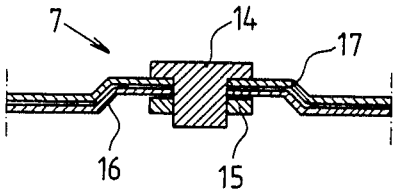
FIGS. 7 and 8 show sectional views of adjusting means in accordance with the invention.
Figure 8:
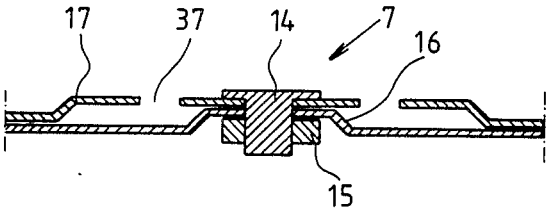

FIGS. 7 and 8 show the means of adjustment 7 used in the upper body protector according to this invention. The means of adjustment can be used in the adjustable connections in accordance with the invention between the chest plate and suspender portions, between the suspender and shoulder portions, as well as between the suspender and back plate portions. The means of adjustment consists for example of a portrusion 16 on the chest plate portion and a corresponding recess 17 on the suspender portion so that the widths of the portrusion and recess correspond to each other but the recess is longer than the portrusion so that the portrusion can be moved along the length of the recess. The surface of the recess 17 includes three holes 37 at an equal distance appart. The surface of the portrusion 16 includes a corresponding hole. Thus, the chest plate and suspender portions can be clamped together by a nut and bolt, when the hole of the bulge is placed in alignment with one of the holes in the recess.

The invention has been explained above in detail by refearing to some advantageous appliances of the invention. They are not meant to limit the invention as the modifications of the invention may vary within the scope of the claims.

What is claimed is:

1. An upper body protector, comprising a semi-rigid upper body shield having a chest plate portion, a suspender portion, and left and right shoulder portions, said chest plate portion adapted to comfortably embrace the chest of a wearer and said suspender portion adapted to be embrace the shoulders of the wearer, said left and right shoulder portions adapted to comfortably embrace the shoulders of the wearer, left and right upper arm portions connected to the respective left and right shoulder portions, first adjustable connecting means connecting said suspender portion and said chest plate portion so that said chest plate position is adjustable in a generally vertical manner with respect to said suspender portion, second adjustable connecting means to connect said left and right shoulder portions to said suspender portions so that the shoulder portions are adjustable with respect to the width of the shoulders of the wearer, said adjustable connecting means each including a threaded fastener extending through corresponding holes in the parts of the protector to be adjustably connected and a connector threaded on the threaded fastener, attaching means connected to the chest plate for securing the chest plate to the body of the wearer, and elastic band means associated with each upper arm portion for holding said upper arm portions to the arms of the wearer.

2. The protector of claim 1, and further comprising a back plate portion connected to said suspender portion, and third adjustable connecting means connecting the back plate portion to said suspender portion so that the back plate portion and suspender portion are generally vertically adjustable.

3. The protector of claim 1, wherein said suspender portion is composed of a left shoulder member and a right shoulder member.

4. The protector of claim 1, wherein said attaching means comprises webbing fixed to said chest plate portion by stitching.

5. The apparatus of claim 4, wherein said attaching means connects the chest plate portion with the back plate portion.

6. The apparatus of claim 1, wherein each adjustable connecting means includes a set of holes.

7. The apparatus of claim 6, wherein each adjustable connecting means includes a projection and a corresponding recess to receive said projection, one of said projection and recess having said set of holes and the other of said projection and recess having an aperture aligned with one of said holes.

* * * * *